US005890946A

United States Patent [19]

Bloomfield

[11] Patent Number: 5,890,946

[45] **Date of Patent: *Apr. 6, 1999**

[54] TWIRLING TOY

[76] Inventor: Steven L. Bloomfield, 1406 Jensen Dr., Pittsburg, Calif. 94565

[ * ] Notice: This patent issued on a continued prosecution application filed under 37 CFR 1.53(d), and is subject to the twenty year patent term provisions of 35 U.S.C. 154(a)(2).

[21] Appl. No.: 865,272

[22] Filed: May 29, 1997

[51] Int. Cl.[6] ..... A63H 1/00; A63H 1/24

[52] U.S. Cl. ..... 446/236; 446/240; 446/242; 446/265

[58] Field of Search ..... 446/236, 240, 446/242, 265, 266

[56] References Cited

U.S. PATENT DOCUMENTS

| | | | |
|---|---|---|---|
| 476,825 | 6/1892 | Schwartz . | |
| 1,404,132 | 1/1922 | Manes . | |
| 1,619,630 | 3/1927 | Pajeau . | |
| 2,112,444 | 3/1938 | McFarlin | 446/240 |
| 2,726,483 | 12/1955 | Hughes et al. . | |
| 2,877,597 | 3/1959 | Brant . | |
| 3,023,000 | 2/1962 | Hess | 446/266 X |
| 3,037,322 | 6/1962 | Baumgartner, Jr. | 446/242 |
| 3,673,731 | 7/1972 | Fahri et al. | 446/240 |
| 3,946,518 | 3/1976 | Ylitalo . | |
| 3,971,158 | 7/1976 | Hanson . | |
| 4,040,625 | 8/1977 | Malafronte | 273/104 |
| 4,044,499 | 8/1977 | Toler . | |
| 4,096,659 | 6/1978 | Keane | 446/240 |
| 4,112,611 | 9/1978 | Kernell . | |
| 4,600,398 | 7/1986 | Fraga | 446/240 |
| 4,848,768 | 7/1989 | Barlow . | |
| 5,073,139 | 12/1991 | Kassarich . | |
| 5,078,643 | 1/1992 | Thill . | |
| 5,125,862 | 6/1992 | Paranto | 446/240 |

*Primary Examiner*—Robert A. Hafer
*Assistant Examiner*—Laura Fossum
*Attorney, Agent, or Firm*—Theodore J. Bielen, Jr.

[57] ABSTRACT

A twirling toy utilizing a hollow member having an outer surface, an inner surface surrounding an inner chamber, and a mouth leading to the inner chamber. An endless rim extends outwardly from the inner surface and into the hollow member inner chamber. An elongated structure is used with the hollow member and includes a first end portion with an endless flange. The endless flange engages the endless rim on the inner surface of hollow member when the hollow member is rotated. A second end portion of the elongated structure includes a hand grip.

6 Claims, 1 Drawing Sheet

TWIRLING TOY

BACKGROUND OF THE INVENTION

The present invention relates to a novel and useful twirling toy.

Toys which are capable of spinning or twirling have often been delightful to children of all ages. For example, twirling toys are capable of emitting sounds or light flashes when the same is twirled either by the use of a gyroscopic action or through the use of a string or lever.

Also, many toys have been devised in which two portions are involved one portion being capable of motivating or rotating another portion. For example, familiar hoop and stick falls into this category of toy.

A twirling toy which is capable of rotating in a controlled manner by the use of a motivating member would be notable advance in the amusement arts.

SUMMARY OF THE INVENTION

In accordance with the present invention a novel and useful twirling toy is herein provided.

A twirling toy of the present invention utilizes a hollow member which has an outer surface, and an inner surface surrounding an inner chamber. The hollow member may include a mouth to the inner chamber and another opening to the inner chamber, along the outer surface, remote from the mouth.

The hollow member is also provided with an endless rim extending outwardly from the inner surface of the hollow member and into the inner chamber thereof. The endless rim may be composed of electrically conductive material such as metal. Also, the hollow member may be provided with an electrically conductive endless collar which extends around the mouth of the hollow member.

An elongated structure such as a rod or staff is also employed with the present invention. The elongated structure is fitted or formed with a first end portion having an endless flange. The endless flange may be in the form of a rounded cap. The endless flange is capable of engaging the endless rim on the inner surface of the hollow member when the hollow member is rotated. A second end portion of the elongated structure is provided with a hand grip for the user. Thus, the user may twirl the hollow member by the use of the elongate structure.

The toy of the present invention may also be provided with alerting means such as a lamp, horn, or the like which is fixed to the hollow member outer surface. Conductors are also employed within the hollow member to connect the alerting means to the endless rim and to the endless collar. Power means interposes the conductor means to provide electric energy. Activation of the alerting means occurs when the first end portion of the elongated structure, formed of electrically conducted material, bridges the endless rim and the endless collar. This can occur in a continuous manner when the hollow member is being twirled by the elongated structure.

In certain embodiments, the source of power may be located in the elongated structure rather than in the hollow member. The elongated structure metallic end portion may also be formed of a magnetic material which is capable of being attracted to the endless rim and/or the endless collar, each of which may also be constructed of magnetic material.

It may be apparent that a novel and useful twirling toy has been described.

It is therefore an object of the present invention to provide a twirling toy which is capable of being twirled by the user in a safe and easy manner.

Another object of the present invention is to provide a twirling toy which utilizes centrifugal force to raise and lower a hollow member relative to an elongated structure, which serves as the motivating force for the twirling of the hollow member.

Yet another object of the present invention is to provide a twirling toy which is capable of providing a light or sound when the toy is twirled at a certain speed.

The invention posses other objects and advantages especially as concerns particular characteristics and features thereof which will become apparent as the specification continues.

For a better understanding of the invention reference is made to the following detailed description of the preferred embodiments thereof which are to be taken in conjunction with the hereinbefore described drawings.

DETAILED DESCRIPTION OF THE PREFERRED EMBODIMENTS

Various aspects of the present invention will evolve from the following detailed description of the preferred embodiments which should be referenced to the hereinabove referenced drawings.

Figure 1:
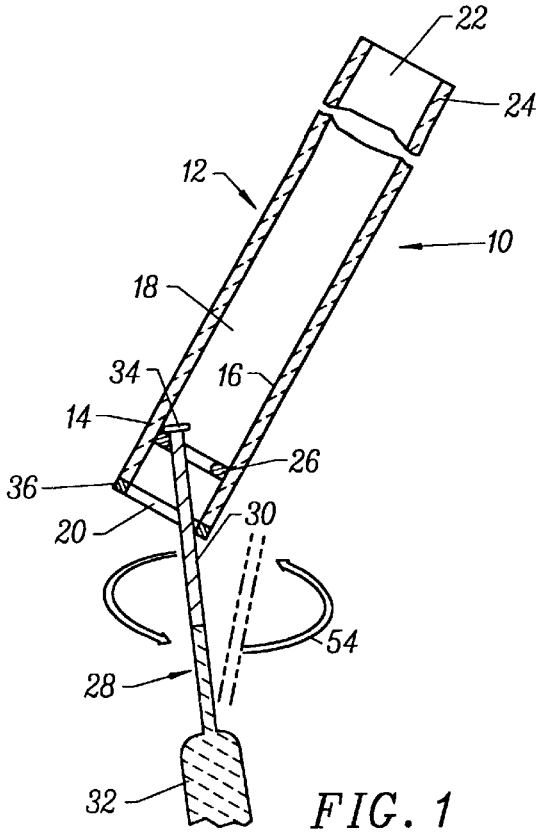
FIG. 1 is a sectional view depicted the hollow member and elongated structure of the present invention in its twirling mode.
Figure 2:
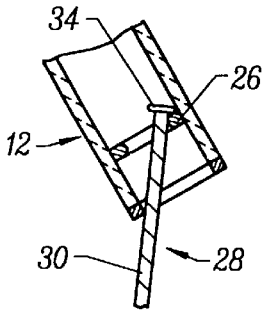
FIG. 2 is a partial sectional view showing the hollow member and elongated structure in a position opposite to that shown in FIG. 1.
Figure 3:
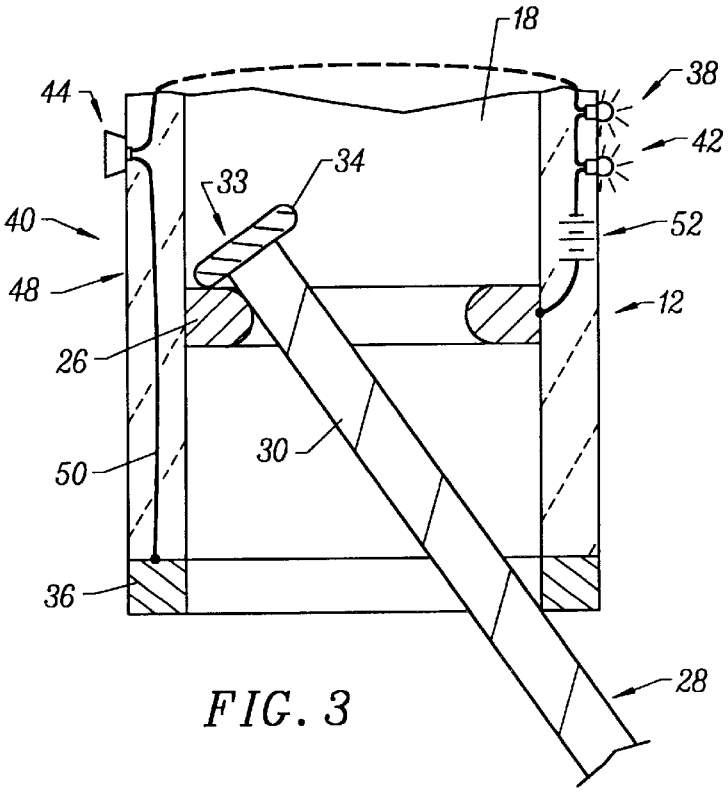
FIG. 3 is an enlarged sectional view of a portion of the twirling toy of the present invention depicting the electrical arrangement to activate the alerting means.

The invention as a whole is depicted in the drawings by reference character 10. Toy 10 includes as one of its elements a hollow member 12 which may be formed of any suitable rigid or semirigid material such as paper, wood, rubber, and the like. Hollow member 12, as shown in the preferred embodiments, FIGS. 1–3 is a cylindrical member having an outer surface 14 and inner surface 16 which forms a chamber 18 therewithin. Inner chamber 18 is accessible through a mouth 20. Opening 22 may also be formed on the other end 24 of hollow member 12, although this is an optional feature. In other words, end 24 of hollow member may be closed. Fixed within chamber 18 is an endless rim 26, which extends into chamber 18 away from inner surface 16. Endless rim 26 is generally an annular shaped member, in this regard. Endless rim 26 may also be formed of an electrically conductive material such as metal, graphite, and the like.

The toy 10 also includes as one of its elements an elongated structure 28. Elongated structure 28 possesses a first end portion 30 and a second end portion or hand grip 32. First end portion 30 may be formed of electrically conductive material such as metal and the like. End 33 of end portion 30 is fitted with an endless flange 34 in the form of a cap. Cap or flange 34 is capable of engaging endless rim 26 as depicted in FIG. 1. Endless collar 36, which may also be formed of electrically conductive material, circumvents end 20 of hollow member 12. First end portion 30 of elongated structure 28 is capable of simultaneously engaging endless collar 36 and endless rim 34. Needless to say, endless collar 36 is a generally a ring-shaped member.

Turning to FIG. 3, it may be seen that alerting means 38 may be incorporated into the structure depicted in FIGS. 1 and 2 of the toy 10. FIG. 3 depicts a toy 40 in which alerting means 38 in the form of a plurality of lamps 42, or sound producing devices such as a horn 44, is fixed to hollow member 12 by any suitable means such as gluing, welding, the use of fasteners, or simply by building the same into hollow member 12.

Conductor means 48, in the form of wire 50, electrically links alerting means 42 with electrically conductive endless rim 26 and electrically conductive endless collar 36. Power means 52, which may be a simple battery, lies in series with alerting means 42, being itself electrically linked to conductor means 46. Bridging endless rim 26 and endless collar 36 with first end portion 30 of elongated structure 28 completes the electrical connection between the same, as well as an electrical circuit, and activates alerting means 42. This occurs when toy 40 is being twirled.

In operation, with respect to FIGS. 1 and 2, the user inserts elongated structure 28 within chamber 18 of hollow member 12. Second end portion or hand grip of elongated structure 28 is grasped by the user and rotated or twirled according to directional arrows 54. Hollow member 12 is, then, also rotated. Two of such positions of rotation are depicted in FIGS. 1 and 2. During such twirling, end portion 30 of elongated structure 28 generally slides along inner surface 16 within chamber 18 toward mouth 20 of hollow member 12. As a result of this action, endless flange or cap 34 of first end portion 30 of elongated structure 28 engages endless rim 26. Also, endless collar 36 is engaged at the same time by first end portion 30. Endless flange or cap 34 prevents elongated structure 28 from leaving chamber 18 and permits hollow member 12 to twirl or rotate relative to elongated structure 28, against the centrifugal force generated by the rotation of hollow member 12. With respect to the embodiment shown in FIG. 3, alerting means 42 is activated in the form of the production of light or sound while such twirling occurs. Thus, toys 10 and 40 are source of great amusement to children and other users.

While in the foregoing embodiments of the invention have been set forth in considerable detail for the purposes of making a complete disclosure of the invention it may be apparent to those of skill in the art that numerous changes may be made in such details without departing from the spirit and principles of the invention.

What is claimed is:

1. A twirling toy, comprising:

a hollow member having an outer surface, an inner surface surrounding an inner chamber, and a mouth to said inner chamber, said hollow member further comprising an endless collar at said mouth to said hollow member on said inner surface of said hollow member;

an endless rim extending from said inner surface of said hollow member within said inner chamber at a distance spaced from said endless collar;

an elongated structure separable from said hollow member and having a transverse dimension substantially smaller than the transverse dimension of the inner chamber, said elongated structure including an elongated portion and having a first end portion with an endless flange extending therefrom, said elongated portion and said endless flange sized and configured such that said endless flange slidingly engages an upper surface of said endless rim while simultaneously said elongated portion slidingly engages with said endless collar on said inner surface of said hollow member; and wherein said hollow member and said elongated structure are dimensioned and arranged such that when said hollow member is rotated by simultaneous sliding engagement of said elongated portion and said endless flange with said endless collar and said upper surface of said endless rim respectively, said elongated structure causes said hollow member to twirl in a skewed manner, and said elongated structure is prevented from leaving the inner chamber of said hollow member through contact of said endless flange with said upper surface of said endless rim.

2. The toy of claim 1 in which said hollow member includes an opening along said outer surface opposite said mouth.

3. The toy of claim 1 which further comprises said endless rim being constructed of an electrically conductive material, an endless collar of electrically conductive material surrounding said mouth of said hollow member, said first end portion of said elongated structure formed of an electrically conductive material, alerting means fixed to said hollow member, conductor means for connecting said alerting means to said endless rim and said endless collar, and power means electrically linked to said conductor means to permit activation of said alerting means when said first end portion of said elongated structure bridges said endless rim on said endless collar.

4. The toy of claim 3 in which said, alerting means comprises a first lamp and said toy further comprises a second lamp electrically connected to said conductor means.

5. The toy of claim 3 in which said alerting means is a sound producing element.

6. The toy of claim 4 in which said endless rim and said endless flange of said first end portion are formed of magnetic material.

* * * * *